US005890927A

United States Patent [19]

Yashima

[11] Patent Number: 5,890,927

[45] Date of Patent: Apr. 6, 1999

[54] REAR HOLDER, AND A WATER-PROOF CONNECTOR WITH THE REAR HOLDER

[75] Inventor: Norimichi Yashima, Shizuoka, Japan

[73] Assignee: Yazaki Corporation, Tokyo, Japan

[21] Appl. No.: 812,769

[22] Filed: Mar. 6, 1997

[30] Foreign Application Priority Data

Mar. 6, 1996 [JP] Japan ..... 8-049193

[51] Int. Cl.[6] ..... H01R 13/40

[52] U.S. Cl. ..... 439/587

[58] Field of Search ..... 439/274, 275, 439/279, 587, 589

[56] References Cited

U.S. PATENT DOCUMENTS 5,580,264 12/1996 Aoyama et al. ..... 439/275

FOREIGN PATENT DOCUMENTS 2-49654 12/1990 Japan ..... H01R 13/42

2-49655 12/1990 Japan ..... H01R 13/42

*Primary Examiner*—Steven L. Stephan

*Assistant Examiner*—Barry M. L. Standig

*Attorney, Agent, or Firm*—Sughrue, Mion, Zinn, Macpeak & Seas, PLLC

[57] ABSTRACT

A rear holder for retaining a terminal in a terminal accommodating chamber of a connector housing with a wire secured to the terminal extending in a rearward direction of the connector housing. The rear holder includes a fitting member having a slit formed therein; a wire clamping member which is integral with the fitting member, the wire clamping member defining a wire insertion hole therein which is continuous with the slit; and locking members for locking the fitting member to the connector housing. The wire is insertable into the slit such that the wire can be retained in the wire insertion hole and the wire clamping member is flexible to allow relative movement thereof with respect to the fitting member when the wire is bent. Therefore, the bend in the wire has a relatively large radius of curvature so that the wire will not break. The wire clamping member includes a pair of spaced arcuate members which together define the wire insertion hole. The arcuate members protrude rearwardly of the fitting portion and are spaced therefrom to allow the flexibility noted above. Further, the thickness of the arcuate members decreases in the rearward direction to increase the flexibility toward the rear of the arcuate members.

17 Claims, 5 Drawing Sheets

REAR HOLDER, AND A WATER-PROOF CONNECTOR WITH THE REAR HOLDER

BACKGROUND OF THE INVENTION

1. Field of the Invention

This invention relates to a rear holder which holds a wire in a water-proof connector which is employed in an environment position where water is liable to flow therein as in the case of the electrical system of a motor vehicle, and to a water-proof connector employing the rear holder.

2. Related art

FIGS. 5 through 8 show a conventional water-proof connector 1 with a rear holder 3.

As shown in these figures, the connector body 5 of the water-proof connector 1 has terminal accommodating chambers 7 and openings 9. In each of the connector bodies, the terminal-side end portion of a wire 13, on which a terminal 11 is connected by crimping, is inserted into each terminal accommodating chamber 7, and the wire is extended outside through the opening 9.

The terminal 11 comprises a conductor crimping portion 15 and a cover crimping portion 17 which are folded over the conductor 19 and the cover 21 of the wire 13 by crimping, respectively. A water-proof plug 23 made of rubber is positioned on each of the wires 13, to prevent the entrance of water through the gap between the opening and the wire.

Each of the terminal accommodating chambers 7 of the connector body has a flexible lance 25. When the terminal side end portion of the wire 13 is inserted into the terminal accommodating chamber 7, the locking portion of the terminal 11 is locked by the lance 25, thus preventing the terminal 11 from disengaging.

The rear holder 3 is fitted in the opening 9. As shown in FIG. 8, the rear holder 3 has a slit 29, and locking portions 31 and 31. Two wires 13 are received in the slit 29. Thereafter, as shown in FIG. 7, with the wires 13 held in the slit, the rear holder 3 is engaged in the opening 9, and it is locked to the connector body 5 with the locking portions 31 and 31.

As shown in FIGS. 5 and 6, the rear holder 3 locked to the connector body 5 cooperates with the cover crimping portions of the terminals and the water-proof plugs 23 to prevent the wires 13 from disengaging from the connector body.

As shown in FIGS. 7 and 8, the slit 29 of the rear holder 3, which holds the wires 13, is linear. Hence, it is impossible for the rear holder 3 to hold the wires 13 in the direction in which the slit extends (i.e., in the lateral directions shown by the arrows X in FIG. 6).

Therefore, if the wire 13 is significantly bent in the directions of the arrow X, then the wire bending force acts on the water-proof plug 23 to form a gap between the plug 23 and the internal surface of the opening 9. As a result, the water-proofing ability of the water-proof plug 23 is lowered, which may result in electrical troubles. In other words, the insulating ability of the connector is lowered, which may cause a malfunction in the associated electrical equipment.

Furthermore, when the wire is bent in the vertical directions of the arrow Y in FIG. 5, the bend has a relatively small radius of curvature, and therefore the wire may be broken.

In view of the foregoing, an object of the invention is to provide a rear holder which has superior water-proofing ability and which prevents the wires from being broken, as well as a water-proof connector employing the rear holder.

SUMMARY OF THE INVENTION

According to the invention, the rear holder is arranged between a wire and the opening of a water-proof connector of the type that the terminal side end portion of the wire is accommodated and the wire is extended through the opening. The rear holder comprises: locking portions which are locked to the water-proof connector; a fitting portion which is fitted in the opening of the water-proof connector; a wire clamping portion which is integral with the fitting portion and has a wire inserting hole; and a slit which extends through the fitting portion and the wire clamping portion to allow the wire to be inserted into the wire inserting hole in the direction of width. The rear holder locks the terminal with the aid of water-proof plug and the cover crimping portion of the terminal which is fixedly mounted on the cover of the wire by crimping. Therefore, when the wire is inserted into the wire inserting hole through the slit, the slit is freely opened and closed, and a space is formed between the fitting portion and the wire clamping portion so that the wire clamping portion is bendable together with the wire.

The rear holder is so designed that, with the slit opened, the wires are inserted into the wire inserting hole of the wire clamping portion in the direction of width, and the rear holder is locked to the connector body with the aid of the locking portions. That is, the rear holder holding the wire is fixedly secured to the connector body, and, therefore, with the aid of the cover crimping portion of the terminal and the water-proof plug, the wire is prevented from coming off the connector body.

Furthermore, a space is formed between the fitting portion and the wire clamping portion, and therefore the wire bend is large in curvature independently of the direction in which the wire is bent. This feature prevents the wire from being broken.

In addition, even when the wire is bent in the direction of the slit, the elasticity of wire clamping portion acts to isolate the force from the water-proof plug, so that in the water-proof connector, unlike the conventional one, no gap is formed between the water-proof plug and the wire and between the connector body and the water-proof plug. Thus, the water-proof plug is prevented from being lowered in water-proof function, and the water-proof connector is free from the electrical troubles that the connector is lowered in insulation, and the relevant electrical equipment operates erroneously.

In the rear holder the wire clamping portion has an abutting portion which, when the wire is bent in the direction of the slit, abuts against the wire, so that the wire clamping portion is bent together with the wire.

Further, in the rear holder, the wire clamping portion is protruded from the fitting portion. Therefore, the bend in the wire has an increased curvature, so that the wire is more positively prevented from being broken.

Further, according to another aspect of the invention, in the rear holder, the wire clamping portion is gradually increased in thickness towards the fitting portion. As a result, the elastic resistance of the wire clamping portion against the bending of the wire is maximum at a position adjacent to the water-proof plug, which more positively prevents the deterioration of the water-proof function and the breakage of the wire.

Furthermore, the cross-section of the wire clamping portion is substantially the same as the cross-section of the wire. Hence, the rear holder may be applied to a wire elliptical in section as well as a wire circular in section.

DETAILED DESCRIPTION OF THE INVENTION

Figure 1:
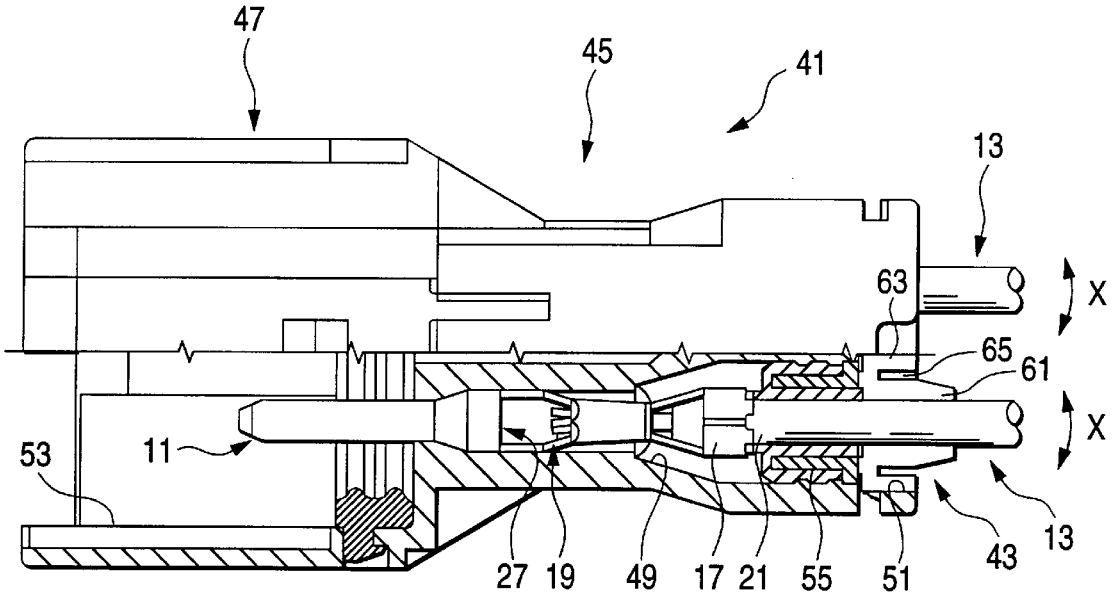
FIG. 1 is a fragmentary sectional view showing a water-proof connector with a rear holder, which constitutes an embodiment of the invention.
Figure 2:
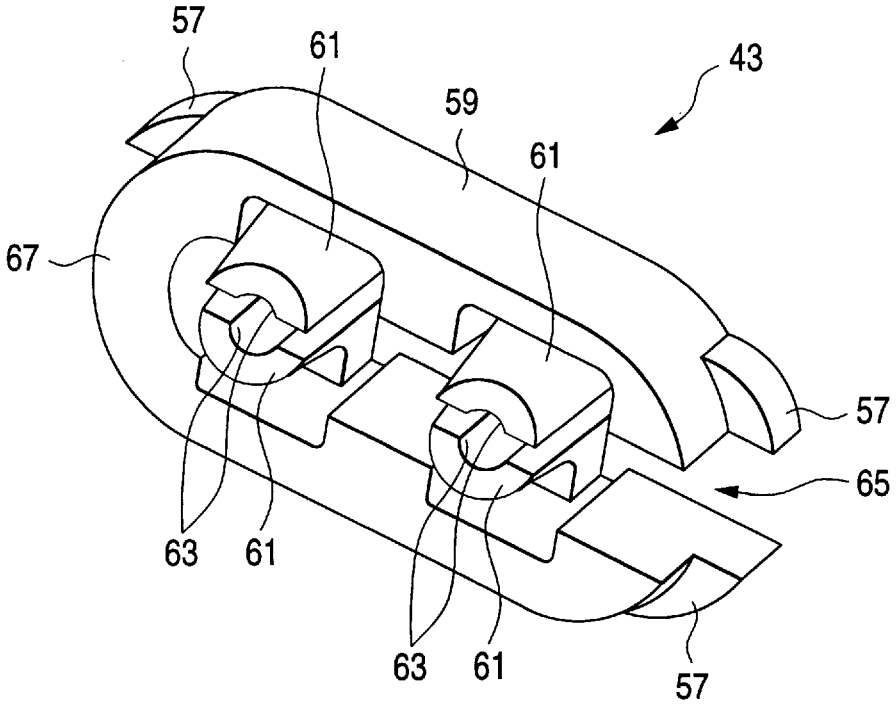
FIG. 2 is a perspective view of the rear holder shown in FIG. 1.
Figure 3:
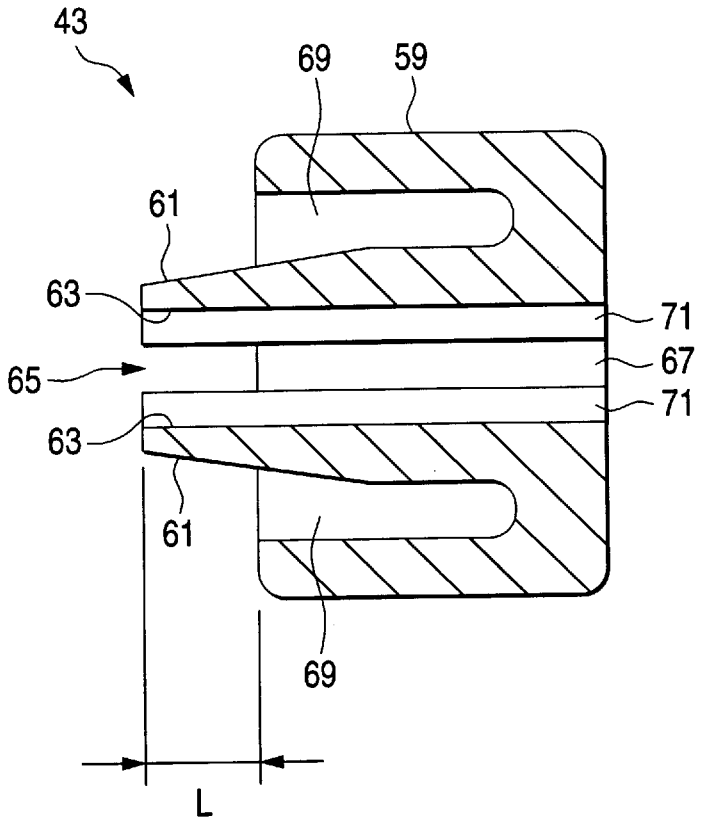
FIG. 3 is a sectional view taken along the central axis of a wire receiving hole in the rear holder.
Figure 4:
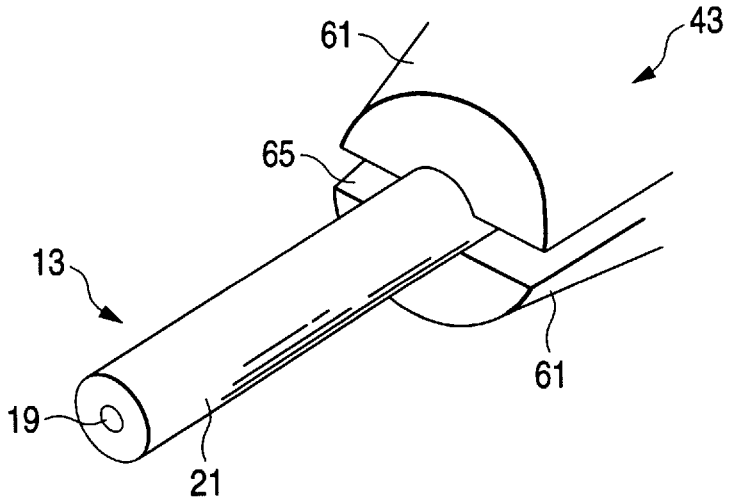
FIG. 4 is a perspective view showing a part of the rear holder into which a wire is inserted.
Figure 5:
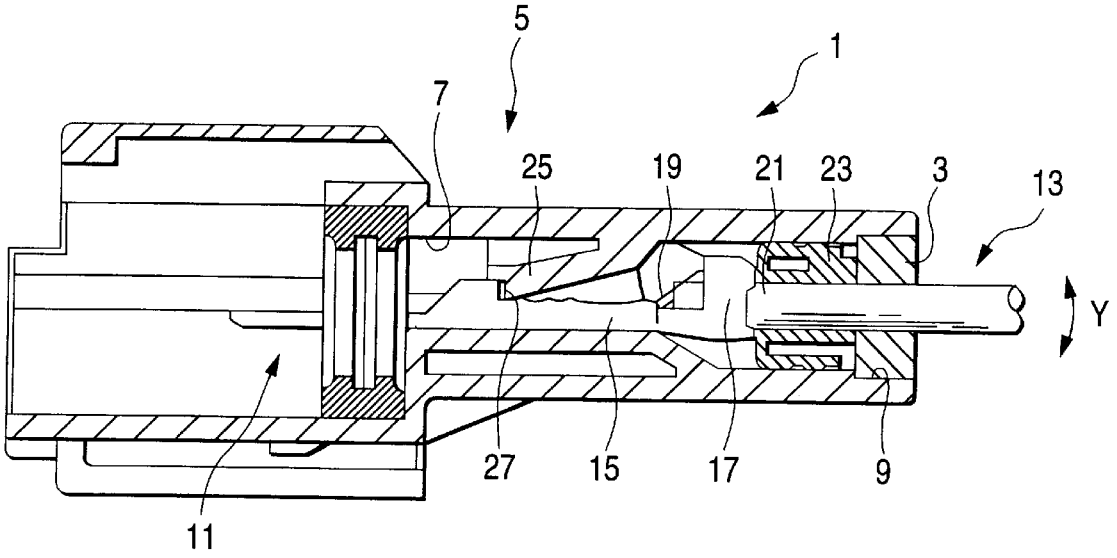
FIG. 5 PRIOR ART
FIGS. 5, 6 and 7 are a longitudinal sectional view, a fragmentary sectional view, and a cross sectional view, respectively, showing a conventional water-proof connector with a rear holder.
Figure 6:
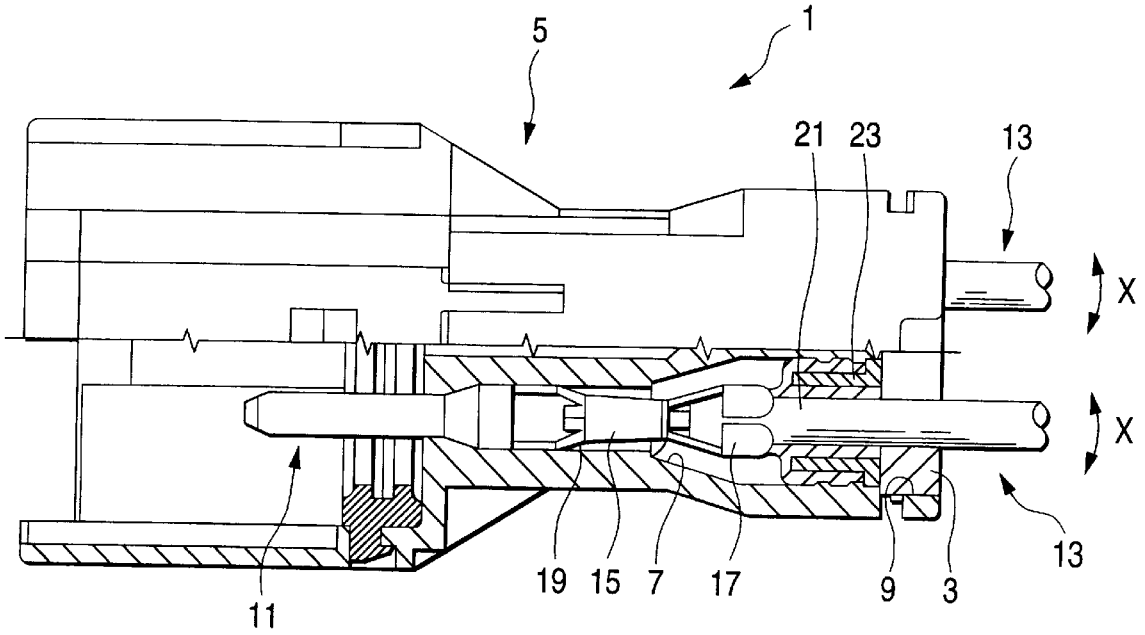
FIG. 6 PRIOR ART
Figure 7:
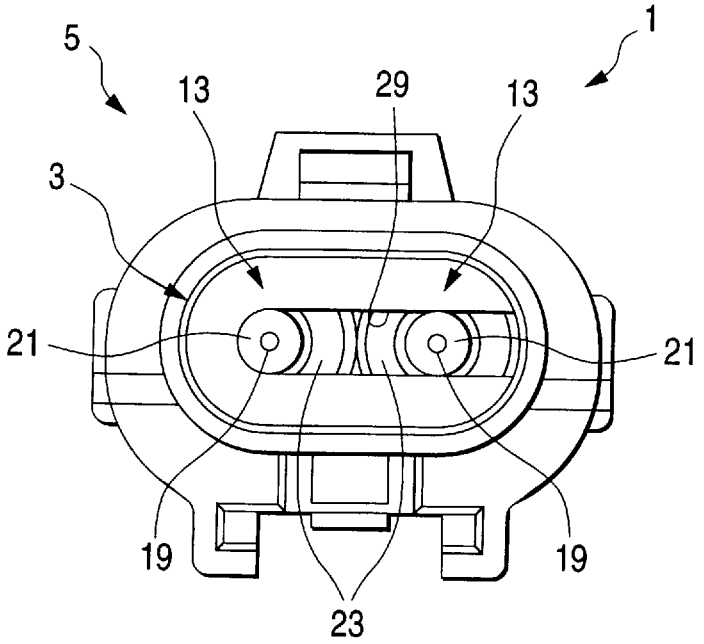
FIG. 7 PRIOR ART
Figure 8:
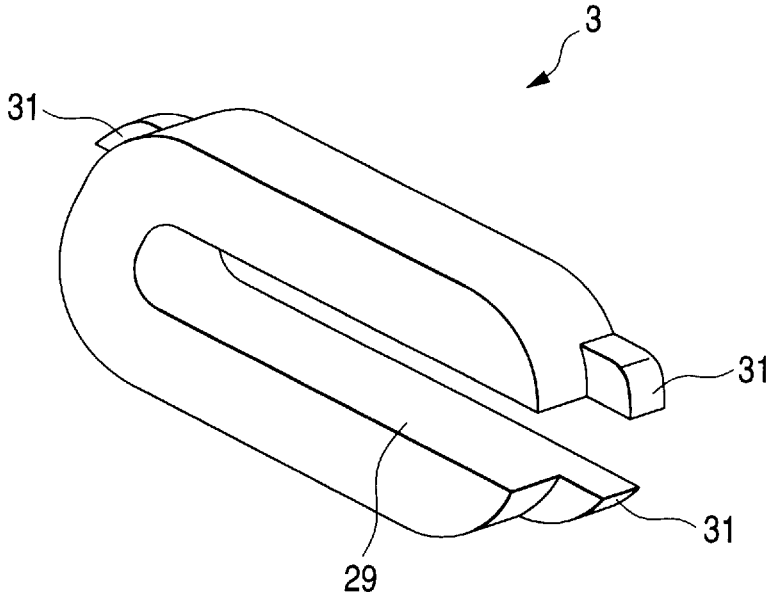
FIG. 8 PRIOR ART
FIG. 8 is a perspective view of the rear holder in the conventional water-proof connector.

FIG. 1 is a fragmental sectional view showing the water-proof connector, the embodiment of the invention. FIG. 2 is a perspective view of the rear holder employed in the water-proof connector. FIG. 3 is a longitudinal sectional view of the rear holder 43. FIG. 4 is a perspective view showing a part of the rear holder 43 into which a wire 11 is inserted.

As shown in these figures, the water-proof connector 41 comprises a connector body 45 and a fitting hood 47 which are provided as a single unit.

As shown in FIG. 1, the connector body 45 has terminal accommodating chambers 49 and an opening 51. The terminal-side end portion of a wire 13, to which a terminal 11 is connected by crimping, is inserted into each of the terminal accommodating chambers, and the other portion of the wire 13 is extended outside the connector body 45 through the opening 51.

The front end portions of the terminals 11 are extended in the cavities 53 of a fitting hood 47. When the water-proof connector 41 is engaged with its mating connector, the terminals 11 are connected to their mating terminals, respectively.

A water-proof plug 55 is fitted on each of the wires 13 in a watertight manner.

Each of the terminal accommodating chambers 49 has a flexible lance. When the terminal-side end portion of the wire 13 is inserted into the terminal accommodating chamber 49, the locking portion 27 of the terminal 22 is locked to the lance. Thereafter, the rear holder 43 is fitted in the opening 51 of the connector body 45.

As shown in FIGS. 2 and 3, the rear holder 43 includes: locking portions 57 which are locked to the connector body 45; a fitting portion 59 which is fitted in the opening 51 of the connector body; wire clamping portions 61 which are integral with the fitting portion 59; and two wire inserting holes 63 formed in the wire clamping portions 61, respectively, in such a manner that they are confronted with each other.

In addition, the U-shaped rear holder 43 has a slit 65 which extends through the wire clamping portions 61. The rear holder 43 is flexible, so that the slit 65 is opened and closed as the coupling portion 67 is bent.

As shown in FIG. 3, a space 69 is formed between each wire clamping portion 61 and the fitting portion 59, so that the wire clamping portion 61 is sufficiently flexible. The wire inserting holes 63 and 63 are defined by arcuate abutting portions 71 and 71 which abut against the wires 13 when the wires 13 are bent in the direction of the slit (in the direction of the arrow X in FIG. 1).

Each of the wire clamping portions 61 protrude by a distance L from the end face of the fitting portion 59, and has a tapered, conical shape, as shown. As shown in FIGS. 2 and 4, each of the wire clamping portions is circular in section corresponding to the cross-section of the wire.

The rear holder 43, and the water-proof connector 41 with the rear holder 43 are designed as described above. Now, the functions of the rear holder and connector will be described.

In order to locate the wires 13 in the water-proof connector 41, first the water-proof plug 55 is mounted on the insulation cover 21 of each of the wires 13 near the cover crimping portion of the terminal 11. Next, with the slit 65 of the rear holder 43 opened a suitable angle, the two wires 13, on which the water proof plugs have been mounted, are inserted into the wire inserting holes 63 of the wire clamping portions 61. Under this condition, the terminals 11 and the water-proof plugs 55 are inserted into the respective terminal accommodating chambers 49. Thereafter, the rear holder 43 is fitted in the opening 51, and the locking portions 57 disposed on the side legs and at the coupling portion 67 of the U-shaped fitting portion 59 are locked to the connector body 45. Thus, the rear holder 43 has been locked to the connector body 45.

As the terminals 11 are inserted into the respective terminal accommodating chambers 49, as was described above, the locking portions 27 are locked to the flexible lances, thus preventing the wires 13 from disengaging (a first means for preventing the wires from disengaging).

The water-proof plugs 55 mounted on the wires 13 are firmly pushed against the opening, to prevent the entrance of water into the connector.

The cover crimping portion 17 of each of the terminals 11 is larger in diameter than the cover 21 of the wire 13. Therefore, when the rear holder 43 is locked to the connector body 45, the rear holder 43 cooperates with the cover crimping portions 17 and the water-proof plugs 55 to prevent the wires 13 from coming off (a second means for preventing the wire from coming off).

As was described before, since the space 69 is provided between the fitting portion of the rear holder 43 and each of the wire clamping portion 61, the clamping portions 61 can be freely flexed. Hence, as the wires 13 are bent, the wire clamping portions 61 are also flexed with the wires 13. That is, owing to the elasticity of the wire clamping portions, the resulting bend in the wires 13 is large in curvature. Thus, the wires 13 may be bent in all direction without being broken.

Even when the wires are bent in the direction of the slit 65, the elasticity of the wire clamping portions 61 acts to isolate the force bending the wires away from the water-proof plugs 55. Therefore, in the water-proof connector, unlike the conventional one, a gap is not formed between the internal surface of the opening 51 of the connector body 45 and the water-proof plugs 55. Thus, the water-proof plugs continue to perform their intended function, so that the water-proof connector and associated electrical equipment are free from experiencing electrical troubles.

As was described above, the wire clamping portions 61 include the abutting portions 71. Hence, in the case where the wires 13 are bent in the direction of the slit, the wire clamping portions are smoothly bent together with the wires. This feature more effectively prevents the deterioration of the water-proof function.

In addition, as was described above, the wire clamping portions 61 are circular in cross section similarly as in the case of the wires 13. Hence, the elastic resistance of the wire clamping portions 61 is independent of the direction in which the wires are bent. Therefore, the wire clamping portions smoothly follow the bending of the wires 13, which more effectively maintains the water-proof function.

Furthermore, as shown in FIG. 3, the end portions of the wire clamping portions protrude from the fitting portion 59 of the rear holder 43, and therefore the curvature of the wires 13 is correspondingly increased, which more effectively prevents the wires 13 from breaking.

The wire clamping portions 61 are elongated. Hence, in the case where the wires 13 are bent in the direction of the slit 65, the wire clamping portions 61 have an increased elastic resistance. This feature more effectively prevents the water-proof plugs 55 from being deteriorated in water-proof function.

Furthermore, as shown in FIG. 3, the thickness of each of the wire clamping portions 61 is gradually increased towards the fitting portion 59 of the rear holder. When the wires 13 are bent, the elastic resistance of the wire clamping portions 61 against the bending of the wires is maximum at the positions adjacent to the water-proof plugs, which increases the effect of preventing the deterioration of the water-proof function of the water-proof plugs 55, and the effect of preventing the breakage of the wires 13.

As was described above, the embodiment is so designed that, when the wires are inserted into the connector or removed therefrom, the slit is opened and closed, and the wire clamping portions are bendable together with the wires. Hence, it is preferable that the rear holder be made of a flexible material. The material is selected among a group of materials such as soft rubber and flexible plastic, depending on the following factors: the surrounding conditions of the location where the water-proof connector is to be used, the mechanical strength and the chemical resistance which are required for the connector, and the period of time for which the connector is to be used.

According to the invention, the wire clamping portion is freely bent together with the wire. Therefore, in the rear holder of the invention, unlike the conventional one, the bend in the wire is large in curvature independently of the direction in which the wire is bent. This feature prevents the wire from being broken.

Further, the wire clamping portion has the abutting portion which, when the wire is bent in the direction of the slit, abuts against the wire. Therefore, when the wire is bent in the direction of the slit, the wire clamping portion smoothly follows the bend of the wire. This feature more positively prevents the deterioration of the water-proof function.

Further, the wire clamping portion protrudes from the fitting portion of the rear holder. Therefore, the bend in the wire is large in curvature, which more positively prevent the wire from being broken.

In addition, since the wire clamping portion is elongated, the wire is high in elastic resistance when bent in the direction of the slit. This feature more positively prevents the deterioration of the water-proof function. Still further, the wire clamping portion is gradually larger in thickness towards the fitting portion, and the elastic resistance of the wire clamping portion against the bending of the wire is maximum at the position adjacent to the water-proof plug, which more positively prevents the deterioration of the water-proof function and the breakage of the wire.

Further, the wire clamping portion is substantially equal in section to the wire, and therefore, the elastic resistance of the wire clamping portion is constant, independently of the direction in which the wire is bent. Hence, the wire clamping portion more positively follows the bending of the wire, which more positively prevents the deterioration of the water proof function.

Furthermore, since the wire clamping portion is substantially equal in section to the wire, the rear holder may be applied to a wire elliptic in section as well as the wire circular in section.

The rear holder having the space between the fitting portion and the wire clamping portion prevents the breakage of the wire independently of the direction in which the wire is bent. In addition, even when the wire is bent in the direction of the slit, the elastic resistance of the wire clamping portion prevents the deterioration in function of the waterproof connector, and electrical troubles such as for instance the lowering of the insulation resistance.

What is claimed is:

1. A rear holder for retaining a terminal in a terminal accommodating chamber of a connector housing with a wire secured to said terminal extending in a rearward direction of said connector housing, said rear holder comprising:

a fitting member having a slit formed therein;

a wire clamping member which is integral with said fitting member, said wire clamping member defining a wire insertion hole therein which is continuous with said slit; and locking means for locking said fitting member to said connector housing, wherein said wire is insertable into said slit such that said wire can be retained in said wire insertion hole and wherein said wire clamping member is flexible to allow relative movement thereof with respect to said fitting member when said wire is bent;

wherein said wire clamping member is spaced from said fitting member to allow said flexibility.

2. The rear holder of claim 1, wherein said wire clamping member includes a pair of spaced arcuate members which together define said wire insertion hole.

3. The rear holder of claim 2, where each of said arcuate members protrudes in said rearward direction beyond said fitting member.

4. The rear holder of claim 3, wherein said arcuate members are tapered to have a thickness which decreases in said rearward direction.

5. The rear holder of claim 2, wherein said slit extends between said arcuate members.

6. The rear holder of claim 1, wherein said fitting member has a substantially U-shape including a pair of side legs.

7. The rear holder of claim 6, wherein said locking means includes projections extending from distal ends of said side legs, respectively.

8. The rear holder of claim 2, wherein said arcuate members are spaced from said fitting member.

9. A water-proof connector comprising:

a connector housing having a terminal accommodating chamber for accommodating a terminal having a wire secured thereto which extends in a rearward direction from said connector housing;

a rear holder for retaining said wire in said terminal accommodating chamber, said rear holder including:

a fitting member having a slit formed therein;

a wire clamping member which is integral with said fitting member, said wire clamping member defining a wire insertion hole therein which is continuous with said slit; and locking means for locking said fitting member to said connector housing, wherein said wire is insertable into said slit such that said wire can be retained in said wire insertion hole and wherein said wire clamping member is flexible to allow relative movement thereof with respect to said fitting member when said wire is bent;

wherein said wire clamping member is spaced from said fitting member to allow said flexibility; and a water-proof plug which circumscribes said wire for preventing water from contacting said terminal, said plug being located between said rear cover and a crimping portion of said terminal which crimps said terminal to an insulating cover of said wire.

10. The connector of claim 9, wherein said wire clamping member includes a pair of spaced arcuate members which together define said wire insertion hole.

11. The connector of claim 10, where each of said arcuate members protrudes in said rearward direction beyond said fitting member.

12. The connector of claim 11, wherein said arcuate members are tapered to have a thickness which decreases in said rearward direction.

13. The connector of claim 10, wherein said slit extends between said arcuate members.

14. The connector of claim 9, wherein said fitting member has a substantially U-shape including a pair of side legs.

15. The connector of claim 14, wherein said locking means includes projections extending from distal ends of said side legs, respectively.

16. The connector of claim 10, wherein said arcuate members are spaced from said fitting member.

17. A rear holder for retaining a terminal in a terminal accommodating chamber of a connector housing with a wire secured to said terminal extending in a rearward direction of said connector housing, said rear holder comprising:

a fitting member having a slit formed therein;

a wire clamping member which is integral with said fitting member, said wire clamping member defining a wire insertion hole therein which is continuous with said slit; and a locking mechanism which locks said fitting member to said connector housing, wherein said wire is insertable into said slit such that said wire can be retained in said wire insertion hole and wherein said wire clamping member is flexible to allow relative movement thereof with respect to said fitting member when said wire is bent;

wherein said wire clamping member is spaced from said fitting member to allow said flexibility.

* * * * *